US006043605A

United States Patent [19]

Park

[11] Patent Number: 6,043,605

[45] Date of Patent: Mar. 28, 2000

[54] PLASMA DISPLAY DEVICE WITH AUXILIARY ELECTRODES AND PROTECTIVE LAYER

[75] Inventor: Deuk-il Park, Suwon, Rep. of Korea

[73] Assignee: Samsung Display Devices Co., Ltd., Kyungki-do, Rep. of Korea

[21] Appl. No.: 09/064,781

[22] Filed: Apr. 23, 1998

[30] Foreign Application Priority Data

Jul. 4, 1997 [KR] Rep. of Korea ..... 97-31160

[51] Int. Cl.[7] ..... H01J 17/49

[52] U.S. Cl. ..... 313/586; 313/584; 313/581; 313/567

[58] Field of Search ..... 313/567, 581, 313/582, 584, 586, 587, 605, 606

[56] References Cited

U.S. PATENT DOCUMENTS

| | | | |
|---|---|---|---|
| 4,562,434 | 12/1985 | Amano | 340/775 |
| 4,737,687 | 4/1988 | Shinoda et al. . | |
| 5,124,615 | 6/1992 | Kim | 313/485 |
| 5,315,213 | 5/1994 | Kim . | |
| 5,717,291 | 2/1998 | Kim | 313/582 |
| 5,744,909 | 4/1998 | Amano | 313/585 |
| 5,747,939 | 5/1998 | Kim et al. | 315/169.4 |

FOREIGN PATENT DOCUMENTS

| | | |
|---|---|---|
| 554172 | 8/1983 | European Pat. Off. . |
| 57-162244 | 6/1982 | Japan . |
| 2223133 | 9/1990 | Japan . |
| 3201342 | 9/1991 | Japan . |
| 5002992 | 1/1993 | Japan . |
| 9092163 | 4/1997 | Japan . |

*Primary Examiner*—Vip Patel
*Assistant Examiner*—Matthew J. Gerike
*Attorney, Agent, or Firm*—Leydig, Voit & Mayer, Ltd.

[57] ABSTRACT

A plasma display device comprising: a rear substrate; a plurality of first electrodes formed on the rear substrate in a predetermined pattern; a dielectric layer formed on the rear substrate where the first electrodes are to be embedded; a plurality of second electrodes formed on the dielectric layer to be orthogonal with respect to the first electrodes; and at least one auxiliary electrode formed between the second electrodes.

14 Claims, 8 Drawing Sheets

PLASMA DISPLAY DEVICE WITH AUXILIARY ELECTRODES AND PROTECTIVE LAYER

BACKGROUND OF THE INVENTION

1. Field of the Invention

The present invention relates to a plasma display device, and more particularly, to a plasma display device utilizing surface discharge.

2. Description of the Related Art

Each pixel of a surface discharge type plasma display device is provided with a scanning electrode and a common electrode facing an address electrode. An addressing discharge occurs between the address electrode and the scanning electrode, and a sustaining discharge occurs between the scanning electrode and the common electrode.

The structure of such a surface discharge type plasma display device is briefly explained with reference to FIG. 1. As shown in FIG. 1, a X-axis electrode 3 is formed on a substrate 2 in a predetermined pattern, and a first dielectric layer 4 is formed on the X-axis electrode 3 and the substrate 2. Formed on the first dielectric layer 4 are a Y-axis electrode 5 perpendicular to the X-axis electrode 3 and a pad electrode 6 which is parallel to the electrode 5 and has a predetermined width and a predetermined length. The pad electrode 6 is electrically connected to the X-axis electrode 3. Further, a second dielectric layer 7 coats the first dielectric layer 4, the Y-axis electrode 5, and the pad electrode 6.

When a predetermined voltage is applied across the electrodes 3 and 5, a discharge occurs between the pad electrode 6 and the Y-axis electrode 5. However, since the pad electrode 6 is electrically connected to the X-axis electrode 3 via a protrusion 6*a* through a hole in the first dielectric layer 4, there are difficulties in manufacturing the device.

Referring to FIG. 2, another embodiment of a conventional surface charge type plasma display device includes a rear substrate 10, address electrodes 11 formed on the rear substrate 10, a dielectric layer 12 formed on the substrate 10 provided with the address electrodes 11, partition walls 13 formed on the dielectric layer 12 for maintaining a discharge distance and preventing cross-talk discharges between pixels, a front substrate 16 to be attached on the rear substrate 10, and scanning electrodes 14 and common electrodes 15 alternately formed on the lower surface of the front substrate 16. In addition, fluorescent layers 17 are formed in discharge spaces defined by the partition walls 13, a dielectric layer 18 is formed on the lower surface of the front substrate 16, the scanning electrodes 14 and the common electrodes 15. A discharge gas fills in the discharge spaces between the rear substrate 10 and the front substrate 16.

As shown in FIG. 3, when a predetermined voltage is applied across the electrodes 14 and 15, ions in the discharge gas gather toward the dielectric layer 12, and a trigger discharge occurs between the address electrodes 11 and the common electrodes 15 resulting in the formation of charged particles at the lower surface of the dielectric layer 18 of the front substrate 16. In this state, as a predetermined voltage (V) is applied across the scanning electrodes 14 and the common electrodes 15 according to a video signal, a sustaining discharge occurs in the discharge space (S). At this moment, the formation of plasma occurs in the gas, and accordingly ultraviolet rays are radiated. Then, the fluorescent material layer is excited by the ultraviolet rays and emits light.

However, the above-described plasma display device has the following problems.

First, since the gap between address electrodes 11 and scanning electrodes 14 is relatively wide, a high voltage, about 300 V, has to be applied across common electrodes 15 and address electrodes 11 to realize a trigger discharge. Therefore, the life span of the display panel of the device is relatively short due to the aging effect of operation at a high voltage.

Second, since a voltage has to be applied across the scanning electrodes and the common electrodes for the sustaining discharge, a complicated driving mechanism and circuit are required. In addition, since an electrostatic capacitance between the scanning electrodes 14 and the common electrodes 15 is relatively small, a high energy plasma is not formed properly and therefore the display device cannot achieve an appropriate brightness. Furthermore, since the sustaining discharge occurs in the space below the scanning electrodes 14 and the common electrodes 15, partition walls 13 are required to prevent optical interference between pixels.

SUMMARY OF THE INVENTION

To solve these problems, it is an objective of the present invention to provide a plasma display device in which the initial discharge voltage is low and which is capable of producing an appropriate ultraviolet radiation to excite fluorescent material.

Accordingly, to achieve the above objective, there is provided a plasma display device comprising: a rear substrate; a plurality of first electrodes formed on the rear substrate in a predetermined pattern; a dielectric layer formed on the rear substrate where the first electrodes are to be embedded; a plurality of second electrodes formed on the dielectric layer to be orthogonal with respect to the first electrodes; and at least one auxiliary electrode formed between the second electrodes.

Here, preferably the auxiliary electrodes are electrically floated.

Further, the plasma display device can further include a front substrate attached to the rear substrate to form discharge spaces and a fluorescent material layer can be formed on the lower surface thereof; and partition walls formed between the front substrate and the dielectric layer to define discharge spaces.

Here, each of the partition walls are formed at the sides of each second electrode to be parallel to the second electrodes. Alternatively, the partition walls may be formed to not be superimposed over the first electrodes and to be parallel to the first electrodes.

According to another aspect of the present invention, a plasma display device comprises: a rear substrate; a plurality of first electrodes formed on the rear substrate in a predetermined pattern; a dielectric layer formed on the rear substrate where the first electrodes are to be embedded; partition walls formed on the dielectric layer in lattice shape to form discharge spaces; a plurality of second electrodes formed to be exposed respectively to one of the discharge spaces defined by the partition walls; and an auxiliary electrode layer formed in any part of the partition walls for a part thereof to be partially exposed to the discharge spaces.

Here, the sides of the auxiliary electrode layer are preferably formed on or under the partition walls for the sides thereof to be exposed to the discharge spaces.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
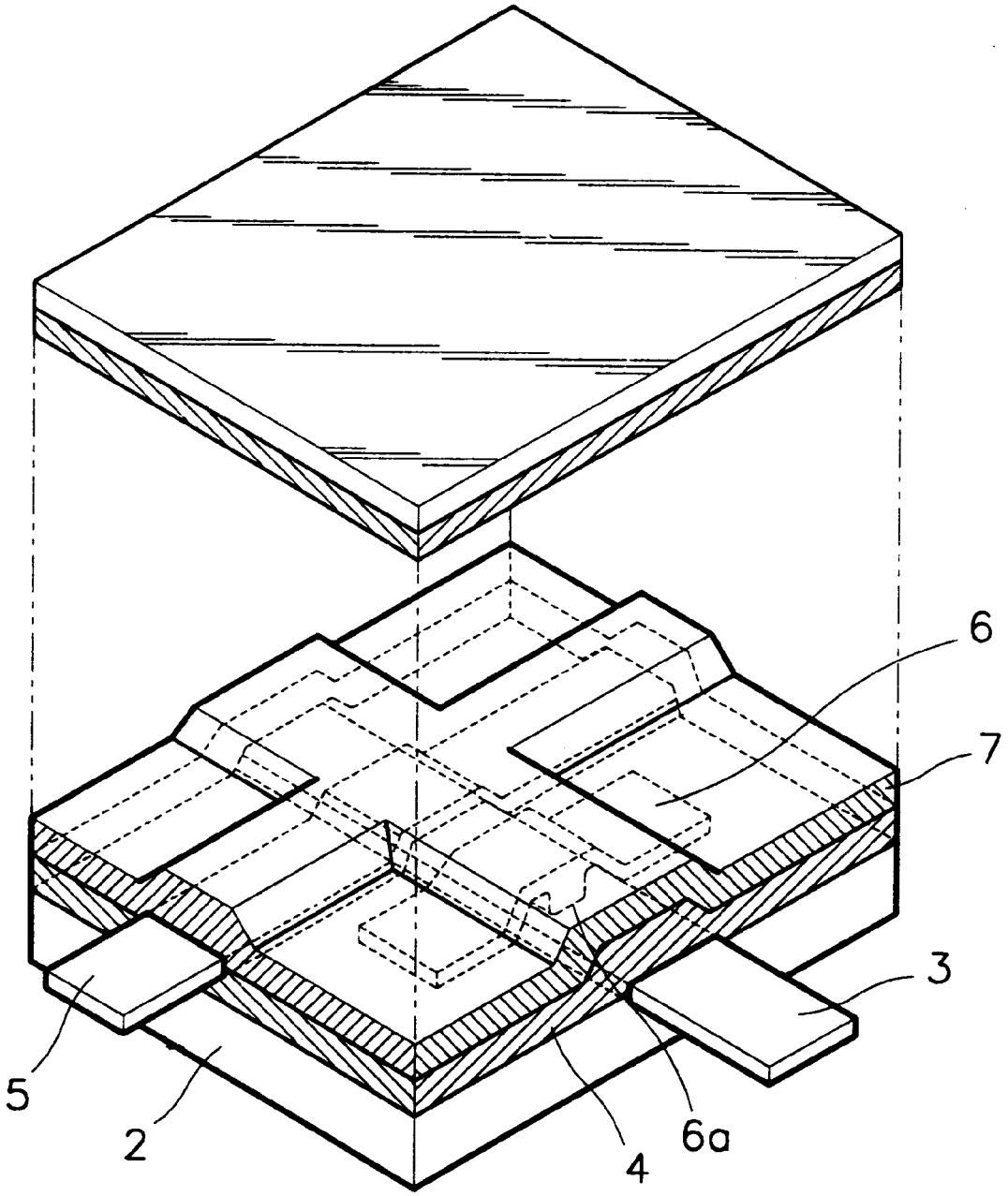
FIG. 1 (PRIOR ART)
FIG. 1 is a partially exploded perspective view illustrating a part of a conventional surface discharge type plasma display device.
Figure 2:
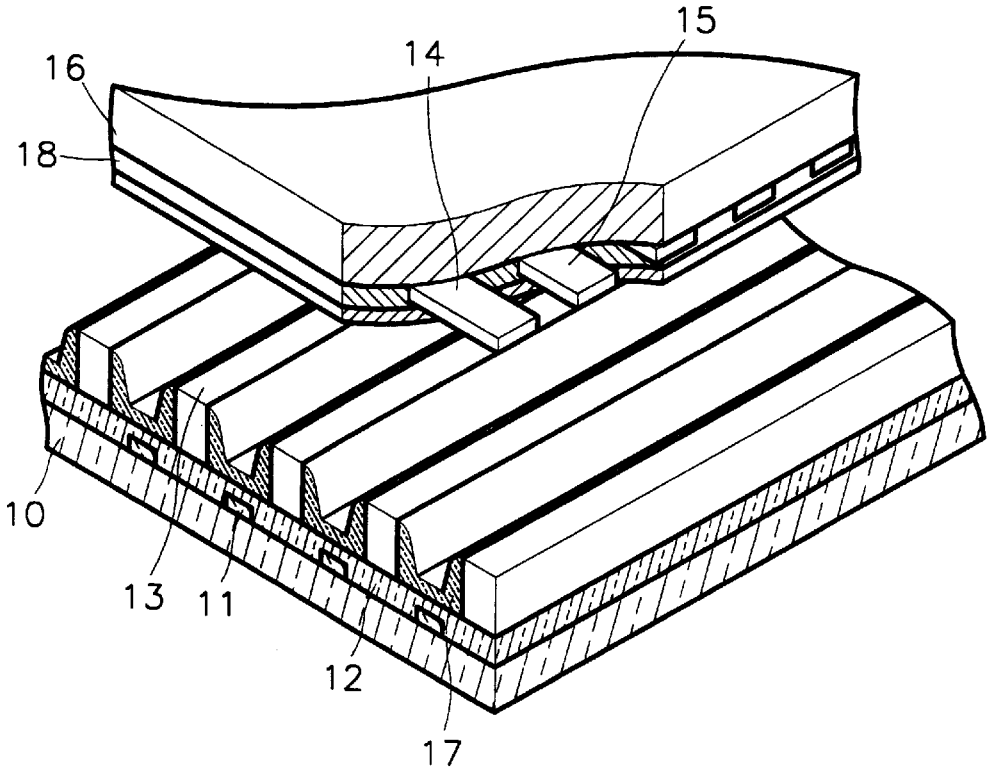
FIG. 2 (PRIOR ART)
FIG. 2 is a partially exploded and partially cut-away perspective view illustrating a part of another conventional surface discharge type plasma display device.
Figure 3:
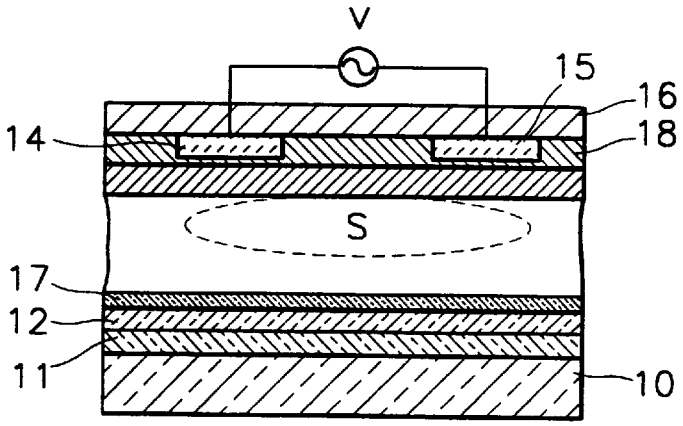
FIG. 3 (PRIOR ART)
FIG. 3 is a sectional view of the embodiment shown in FIG. 2 but not in an exploded state.
Figure 4:
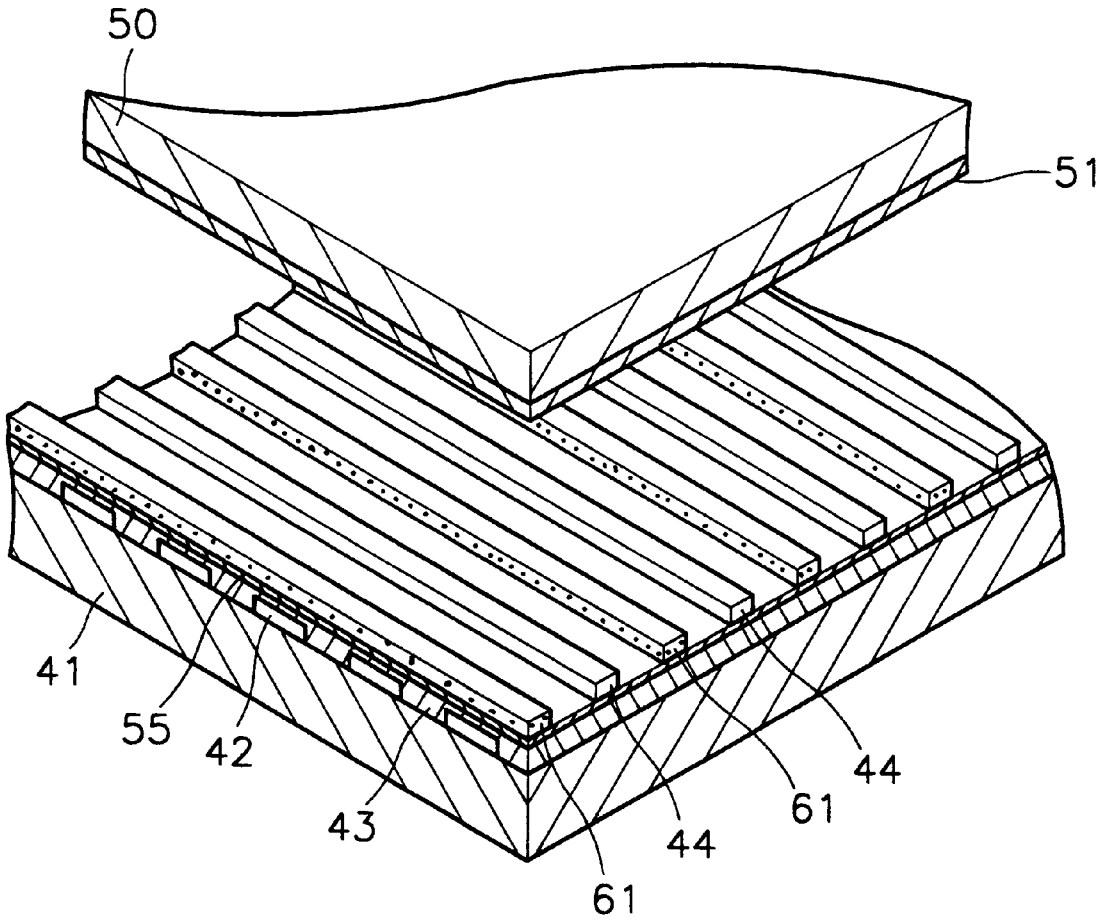
FIG. 4 is a partially exploded perspective view illustrating a part of an embodiment of a plasma display device according to the present invention.
Figure 5:
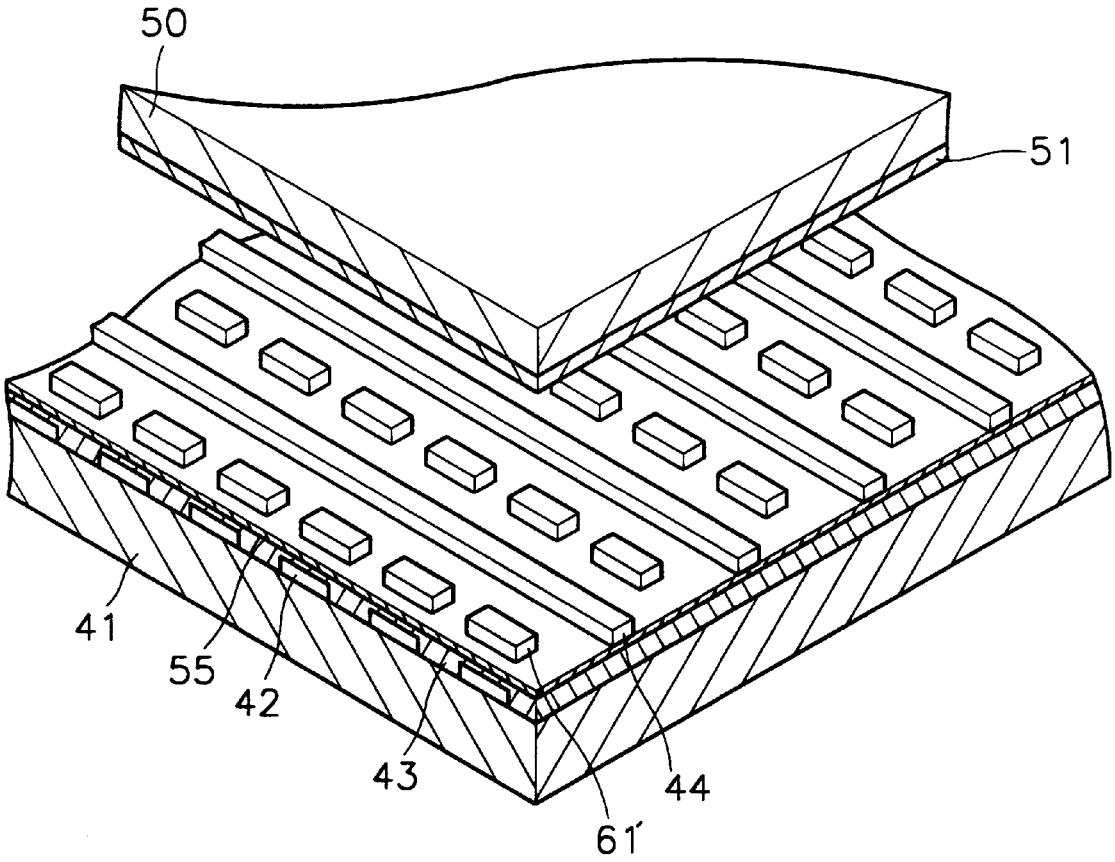
FIG. 5 is a partially exploded perspective view illustrating another example of the auxiliary electrodes of a plasma display device according to the present invention.

Referring to FIG. 4 showing a plasma display device according to the present invention, first electrodes 42 in strip shape are formed on a rear substrate 41, a dielectric layer 43 is formed on the rear substrate 41 and the first electrodes 42. Second electrodes 44 in strip shape are formed on the dielectric layer 43 orthogonal to the first electrodes 42. In addition, at least one auxiliary electrode 61 is parallel to the second electrodes 44 between the second electrodes 44. The auxiliary electrodes 61 are electrically floated. Alternatively, as shown in FIG. 5, auxiliary electrodes 61' may be discontinuous with a predetermined width and a predetermined length. In this case, the auxiliary electrodes 61' are preferably formed at positions corresponding to the first electrodes 42.

A protective film 55 made of MgO is formed on the dielectric layer 43. Alternatively, the protective film 55 may be formed in such a manner as to embed the second electrodes 44 and the auxiliary electrodes 61, though it is not shown. The rear substrate 41 provided with the first and second electrodes 42 and 44, the dielectric layer 43, and the auxiliary electrodes 61 is bonded to a front substrate 50 provided with a fluorescent material layer 51, and discharge spaces between the rear substrate 41 and the front substrate 50 are filled with a gas.

Figure 6:
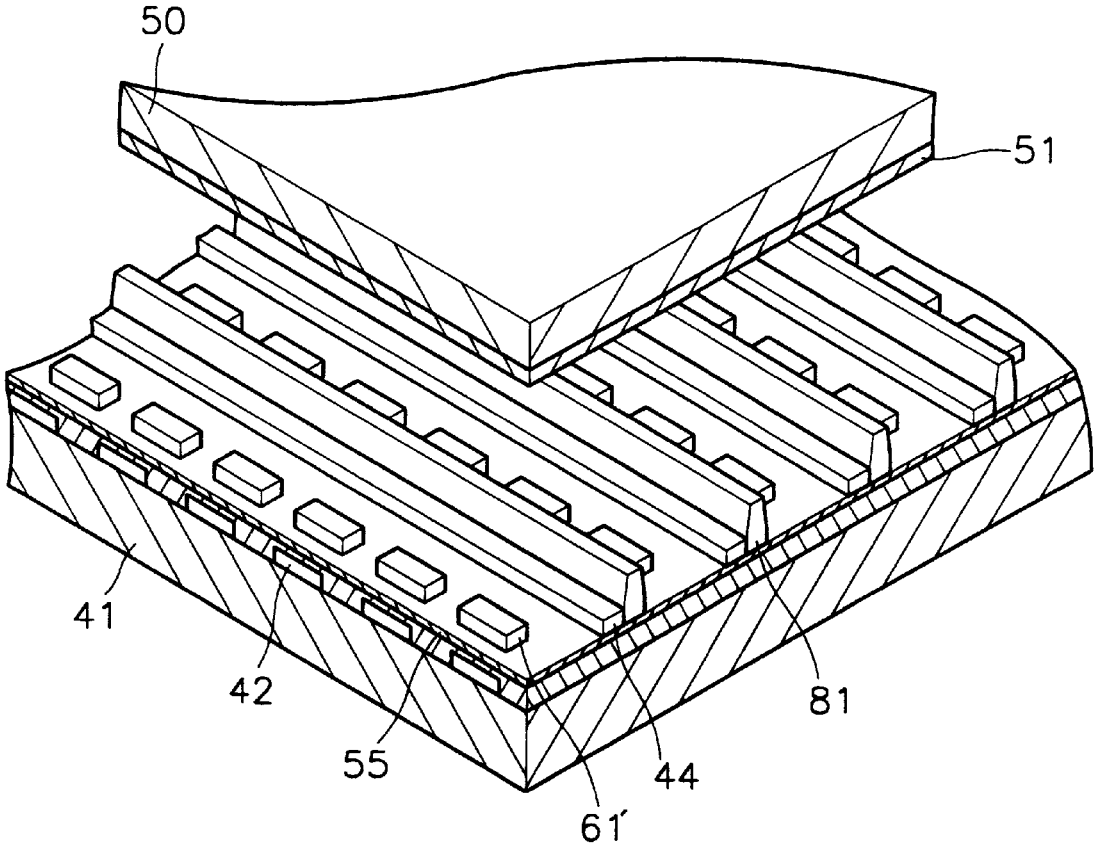
FIGS. 6 and 7 are partially exploded perspective views respectively illustrating partition walls of a plasma display device according to the present invention.
Figure 7:
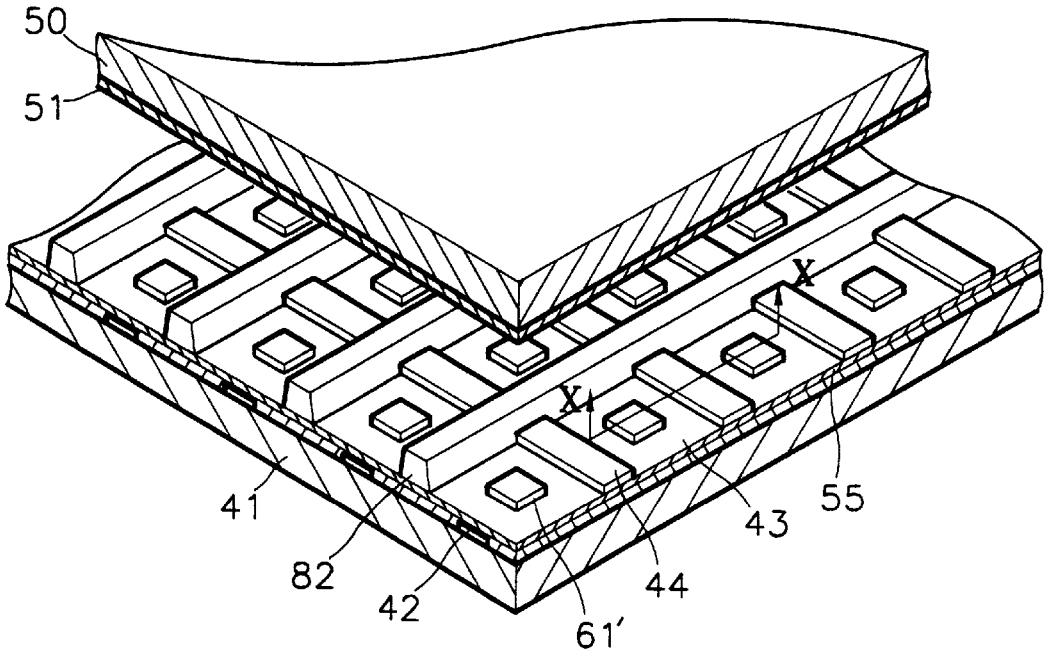

In addition, as shown in FIG. 6, partition walls 81 are located between the rear substrate 41 and the front substrate 50 contiguous to and parallel to the first electrodes 44. As shown in FIG. 7, when the auxiliary electrodes 61' are discontinuously formed, it is preferable that the partition walls 82 be formed between the auxiliary electrodes 61' parallel to the first electrodes 42.

Figure 10:
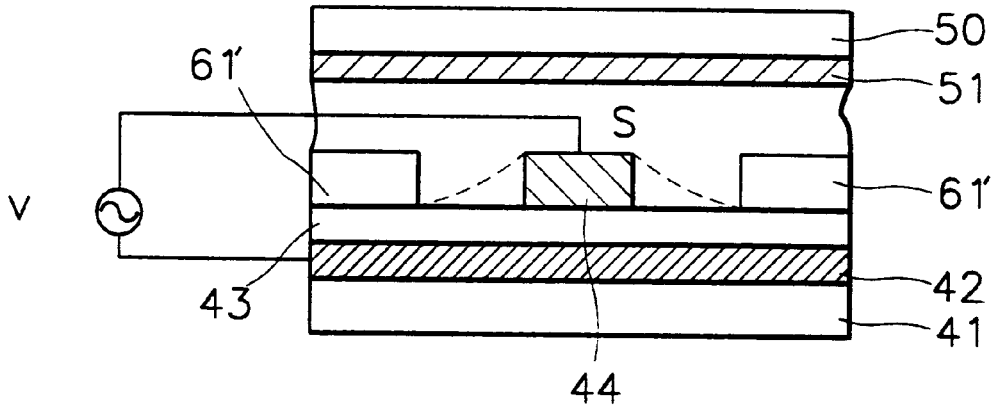
FIG. 10 is a sectional view taken along line X—X of FIG. 7.

In the operation of this embodiment of a plasma display device having the configuration as described above, when a first AC voltage is applied across the first electrodes 42 and the second electrodes 44 (FIG. 7), a sliding discharge, that is, a trigger discharge, occurs between the first and second electrodes 42 and 44 as shown in FIG. 10.

In this state, once a second AC voltage higher than the first AC voltage is applied across the second electrodes 44 and the auxiliary electrodes 61' according to a video signal, the range of sliding discharge is enlarged, and a main discharge occurs between the second electrodes 44 and the auxiliary electrodes 61'. Current at the time of main discharge flows, in turn, via the first electrode 42, the dielectric layer 43, the second electrodes 44, the discharge space (S), the auxiliary electrodes 61', and the dielectric layer 43 and back to the first electrode 42. When the polarities of the first electrode 42 and the second electrode 44 are reversed respectively, the path of the current flow is also reversed.

At this moment, gas is ionized to form a plasma between the second electrode 44 and the auxiliary electrodes 61', and, as a result, ultraviolet photons are emitted to excite the fluorescent material layer. The excited fluorescent material layer then emits visible light to illuminate a pixel.

Figure 8:
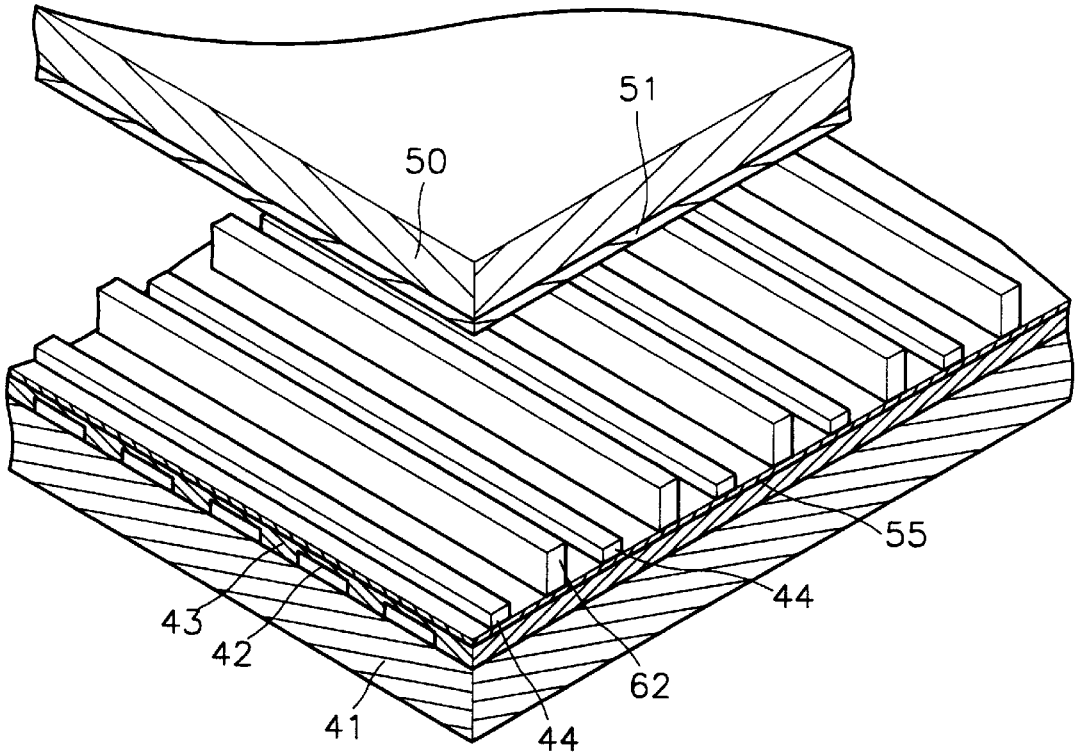
FIG. 8 is a partially exploded perspective view illustrating a part of another embodiment of a plasma display device according to the present invention.

Another embodiment of a plasma display device according to the present invention is shown in FIG. 8. Here, the reference numerals that are the same as those of previous drawings denote similar members. As shown in FIG. 8, second electrodes 44 are formed in strip shape on a rear substrate 41 provided with first electrodes 42 and a dielectric layer 43 and cross the first electrodes 42. Further, auxiliary electrodes 62 are formed in strip shape between the second electrodes 44 to have a height which is higher than that of the second electrodes 44 and parallel to the second electrodes 44. The auxiliary electrodes 62 are electrically floated. Furthermore, partition walls (not shown) are orthogonal with respect to the auxiliary electrodes 62 and to define discharge spaces in a lattice arrangement.

Figure 9:
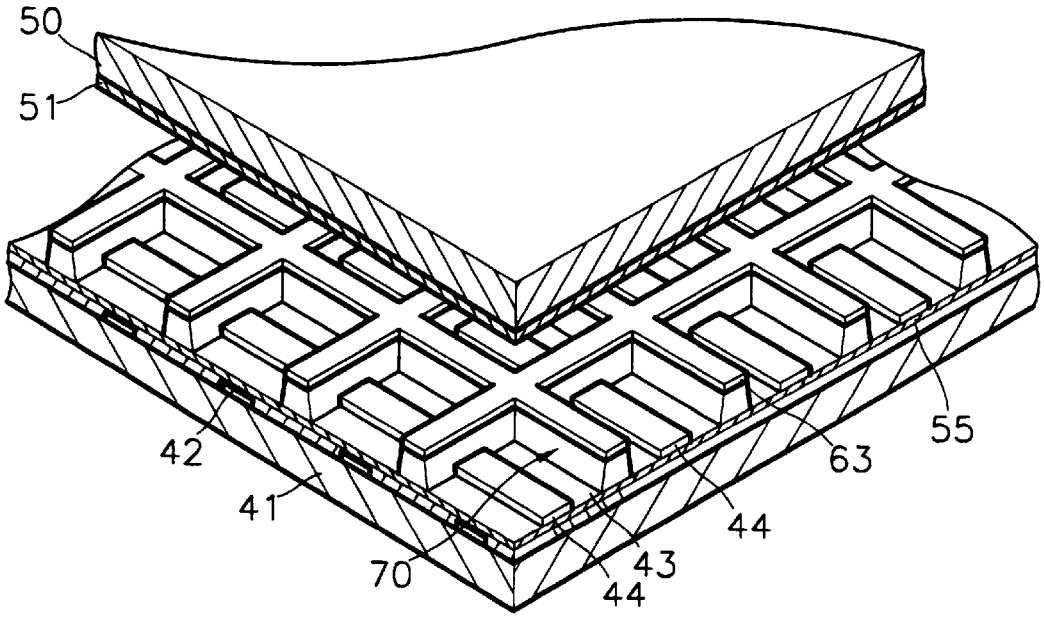
FIG. 9 is a partially exploded perspective view illustrating a part of still another embodiment of a plasma display device according to the present invention.

Referring to FIG. 9 showing still another embodiment of a plasma display device according to the present invention, second electrodes 44 are formed in strip shape on a rear substrate 41 provided with first electrodes 42 and a dielectric layer 43 to be orthogonal with respect to the first electrodes 42. Partition walls 70 are formed in a lattice on the dielectric layer 43 to define discharge spaces, and a corresponding portion of the second electrodes 44 is exposed in each of the discharge spaces. An auxiliary electrode layer 63 is formed on the partition walls 70 so the sides of the auxiliary electrode layer 63 are exposed to the corresponding discharge spaces. Alternatively, the auxiliary electrode layer 63 may be formed under the partition walls. Here the auxiliary electrode layer 63 is not electrically coupled to the second electrodes 44 and is electrically floated.

Though the partition walls 70 are formed in lattice in this embodiment, but not limited thereto, the partition walls 70 may be formed in various shapes such as a honeycomb configuration, or other configurations including pentagons, hexagons or the like.

The discharge of the plasma display device according to this embodiment occurs in the same manner as described above.

In the embodiments described above, the auxiliary electrodes, the first electrodes and the second electrodes may be formed by vapor deposition of an electrically conductive metal or of indium tin oxide (ITO) with a predetermined pattern. Alternatively, wire can be utilized for the first and second electrodes.

The plasma display according to the present invention has the following advantages.

First, the voltage for the initial discharge can be lowered by utilizing a sliding discharge occurring on the dielectric layer by the first and second electrodes.

Second, since the dielectric layer is disposed between the first electrodes and the second electrodes, the sliding charge can occur easily.

Third, since the addressing voltage can be adequately increased for a sustaining discharge instead of applying a voltage across the second electrodes and the auxiliary electrodes, the driving mechanism and circuits of the device can be simplified. The electrostatic capacitance between the first and second electrodes is increased, wherefore a plasma of a high energy level can be formed. This effectuates increasing the brightness of the device.

Fourth, since the height of the auxiliary electrodes is higher than that of the second electrodes, the auxiliary electrodes can act as partition walls, and therefore the structure of the device can be simplified.

Fifth, discharge current and voltage can be adjusted by changing the distance between the auxiliary electrodes and the second electrodes.

Sixth, by employing the auxiliary electrodes, the capacitance for discharge increases resulting in increased brightness of the device.

Although preferred embodiments of the present invention have been described with reference to accompanying drawings for purposes of illustration, it is understood that various modifications may be made by those skilled in the art within the spirit and scope of the invention.

The plasma display device according to the present invention utilizing the above-described discharge can be used as a flat panel type light source of a liquid crystal device (LCD) or the like.

What is claimed is:

1. A plasma display device comprising:

a rear substrate;

first electrodes on the rear substrate in a pattern;

a dielectric layer on the rear substrate embedding the first electrodes;

second electrodes on the dielectric layer and orthogonal to the first electrodes; and at least one auxiliary electrode located on the dielectric layer between a pair of the second electrodes.

2. The plasma display device as claimed in claim 1, wherein the auxiliary electrodes are electrically floating.

3. The plasma display device as claimed in claim 1, wherein the auxiliary electrodes are discontinuous, have a width and a length, and are parallel to the second electrodes.

4. The plasma display device as claimed in claim 1, further comprising:

a front substrate attached to the rear substrate to form discharge spaces between the front and rear substrates, wherein a fluorescent material is located on a lower surface of the front substrate; and partition walls located between the front substrate and the dielectric layer and defining discharge spaces.

5. The plasma display device as claimed in claim 4, wherein the partition walls are located beside each of the second electrodes and parallel to the second electrodes.

6. The plasma display device as claimed in claim 4, including a plurality of auxiliary electrodes that are discontinuous, have a width and a length, and are parallel to the second electrodes.

7. The plasma display device as claimed in claim 6, wherein the partition walls are located between the auxiliary electrodes, parallel to the first electrodes.

8. The plasma display device as claimed in claim 1, wherein the auxiliary electrodes are higher than the second electrodes with respect to the rear substrate.

9. The plasma display device as claimed in claim 1, including a protective film on one of the dielectric layer and the second electrodes.

10. A plasma display device comprising:

a rear substrate;

first electrodes on the rear substrate in a pattern;

a dielectric layer on the rear substrate embedding the first electrodes;

partition walls on the dielectric layer in a lattice arrangement and defining discharge spaces;

second electrodes exposed respectively to one of the discharge spaces defined by the partition walls; and an auxiliary electrode layer located on part of the partition walls and partially exposed to the discharge spaces.

11. The plasma display device as claimed in claim 10, wherein the auxiliary electrode layer is located on the partition walls with sides thereof exposed to the discharge spaces.

12. The plasma display device as claimed in claim 10, wherein the auxiliary electrode layer is located under the partition walls and sides thereof are exposed to the discharge spaces.

13. The plasma display device as claimed in claim 10, wherein the auxiliary electrode layer is electrically floating.

14. The plasma display device as claimed in claim 10, including a protective film on one of the dielectric layer and the second electrodes.

* * * * *